United States Patent [19]

Lu

[11] Patent Number: 5,076,972

[45] Date of Patent: Dec. 31, 1991

[54] EVAPORATIVE AIR CONDITIONER WITH ROTARY FAN SERVING AS FLUID SUPPLIER, ATOMIZER AND BLOWER

[76] Inventor: Qiu-Jiang Lu, 740 E. 300 S. #101, Salt Lake City, Utah 84102

[21] Appl. No.: 579,574

[22] Filed: Sep. 10, 1990

[51] Int. Cl.[5] ..... B01F 3/04

[52] U.S. Cl. ..... 261/24; 261/119.1

[58] Field of Search ..... 261/24, 119.1

[56] References Cited

U.S. PATENT DOCUMENTS

| | | | |
|---|---|---|---|
| 1,042,055 | 10/1912 | Thiesen | 261/119.1 |
| 2,853,152 | 9/1958 | Swift | 261/119.1 |
| 3,778,979 | 12/1973 | Friedling | 261/119.1 |
| 3,950,151 | 4/1976 | Martin | 261/119.1 |
| 4,172,865 | 10/1979 | Steier | 261/191.1 |
| 4,711,294 | 12/1987 | Jacobs et al. | 261/119.1 |

*Primary Examiner*—Tim Miles

[57] ABSTRACT

An evaporative air conditioner with rotary fan playing multiple roles of supplying fluid, atomizing fluid and blowing air. The air conditioner comprises a housing (1) having four side grilles and a top cover (5). An electric motor (6) is vertically mounted to the cover with its rotating shaft directed downward and connected to a rotary fan (8). The fan has a cavity formed by fan blades (9) and a cap (10). Fluid stored at the base portion of the conditioner is sucked into the cavity and supplied onto the blades that produce droplets by impacting the supplied fluid.

6 Claims, 2 Drawing Sheets

INVENTOR
QIU-JIANG LU

INVENTOR
QIU-JIANG LU

EVAPORATIVE AIR CONDITIONER WITH ROTARY FAN SERVING AS FLUID SUPPLIER, ATOMIZER AND BLOWER

This invention relates to evaporative air conditioners, and more particularly to an evaporative air conditioner which uses a rotary fan for multiple purposes of supplying fluid, atomizing fluid and blowing air.

A wide variety of evaporative air conditioners have been developed for vehicular or residential use. For example, air conditioners of compressor type have long been recognized as beneficial for cooling capability and comfort, but difficult to maintain and expansive to construct. On the other hand, air conditioners of swamp-cooler type are relatively inexpensive to manufacture and have been widely used for residential air cooling purposes, but are not capable of providing sufficient cooling for outdoor vehicular use, especially in hot summer when the sunlight is strongest. The present invention is to fill the gap between these two types of air conditioners, that is, to provide an evaporative air conditioner which is both economical in construction and capable of producing sufficient cooling for vehicular use.

GENERAL PURPOSES AND OBJECTS OF THE INVENTION

A main object of the invention is to provide a novel evaporative air conditioner which is relatively simple in construction, which is compact in size, which is relatively light in weight and which provides a relatively great cooling capability with minimum consumption of electrical energy.

A further object of the invention is to provide an evaporative air conditioner of the type employing a rotary fan, the conditioner being relatively inexpensive to manufacture, being durable in construction and involving a minimum number of parts.

A still further object of the invention is to provide an evaporative air conditioner which requires no fluid pump and cooler pad, which needs a relatively small amount of maintenance and which is reliable in operation.

A still further object of the invention is to provide an evaporative air conditioner of the type employing a rotary fan serving as fluid supplier and atomizer as well as air blower.

DESCRIPTION OF THE INVENTION

The invention comprises a housing having four side grilles and a top cover, an electric motor being vertically mounted on said cover with its motor rotating shaft pointing downward, a rotary fan being vertically connected to said shaft, a bent thin wall with its top edge connected to said cover, said wall partially surrounding said fan with open part of the wall serving as air flow exit, and fluid stored at base portion of said housing.

Novel features of construction and operation of the device will be clearly apparent during the course of the following description, reference being had to the accompanying drawings wherein has been illustrated a preferred form of the device.

Figure 1:
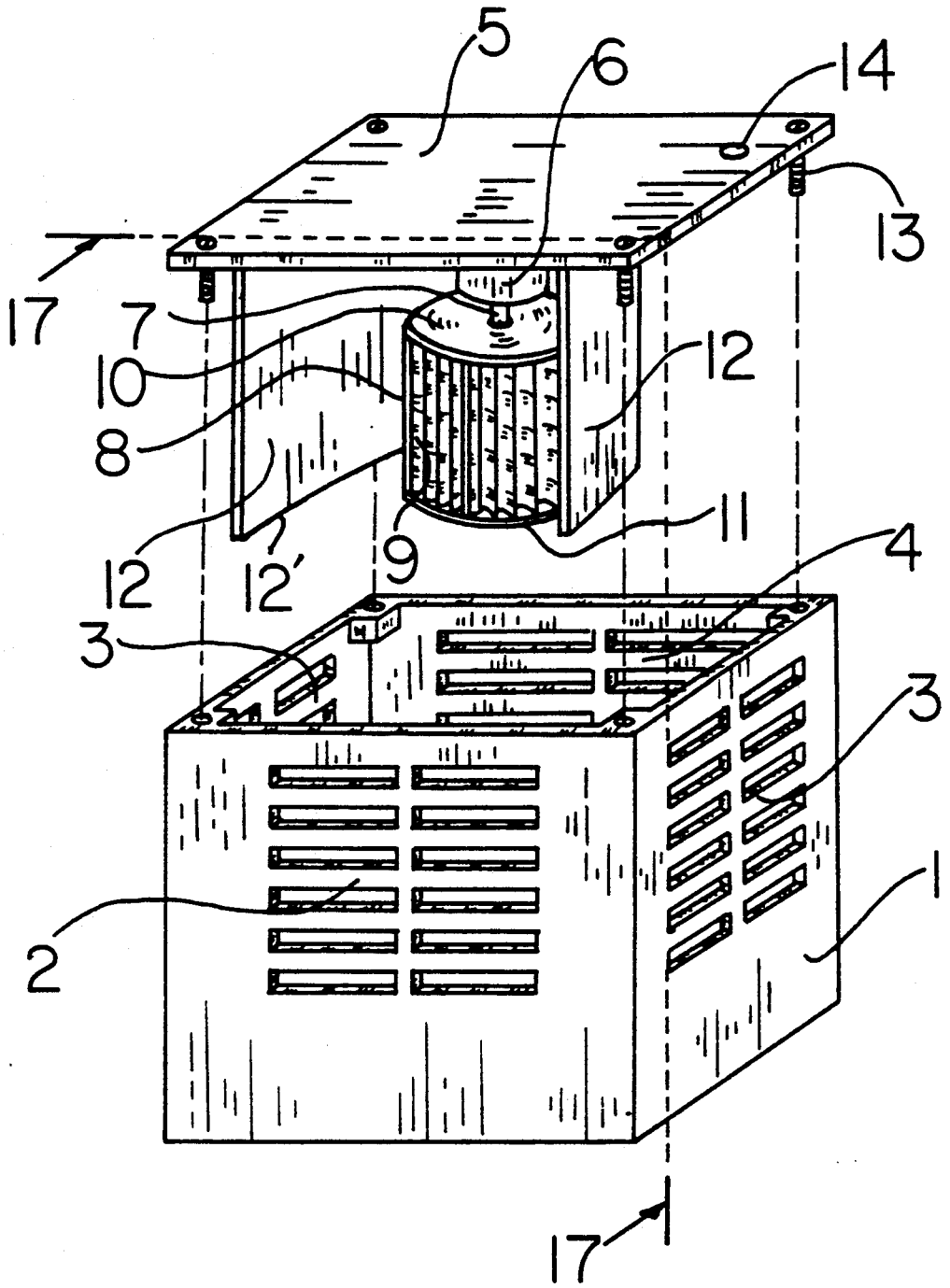
FIG. 1 is a perspective view of an evaporative air conditioner constructed in accordance with the present invention, with its cover being lifted.

Referring to the drawings, the evaporative conditioner comprises a housing 1 having side grille air inlets 3, rear grille inlet 4, front grille outlet 2, and a cover 5 secured to the housing by bolts 13. Vertically mounted to said cover is an electric motor 6 whose rotating shaft 7 is directed downward and connected with vertically oriented rotary fan 8 having a cavity formed by fan blades 9 which are retained by cap 10 and ring 11. Due to the upper cap blocking air flow, the such installed rotary fan can suck air into said cavity only from below, and direct air out through gaps between the fan blades.

Surrounding the rotary fan is air flow guiding wall 12 which guides incoming air to exit through grille outlet 2. The upper edge of the guiding wall is mounted to cover 5 so that incoming air from grille inlets 3 and 4 can flow into said cavity only from underneath the lower edge 12' of the guiding wall and skim closely over surface of fluid 15 stored at the base portion of the housing 1 to produce maximum surface evaporating rate. Fluid of the conditioner is added through fill hole 14.

DESCRIPTION OF OPERATION

Figure 2:
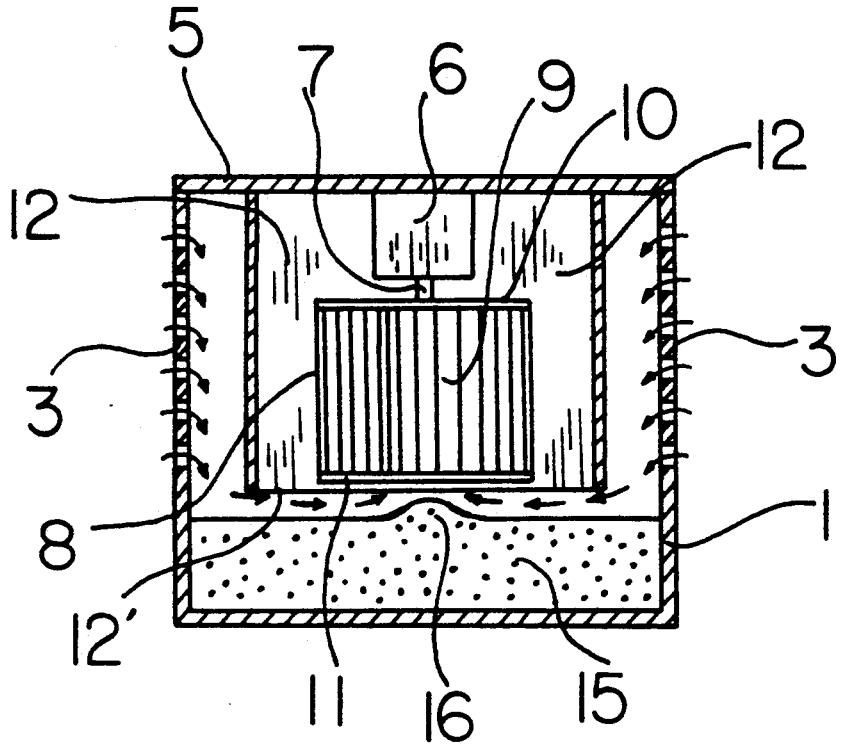
FIG. 2 is a vertical cross-sectional view taken substantially on line 17—17 of FIG. 1 with the cover closed.

In operation, the rotating fan 8 creates a partial vacuum inside the fan cavity formed by the fan blades 9 and the cap 10. As a result, air outside the device flows into the housing 1 through the side grille inlets 3 and the rear grille inlet 4 to fill the vacuum. Due to the blocking effect of the guiding wall 12, all the incoming air flows underneath the lower edge 12' of the wall and skims fast and closely over the surface of the fluid 15, as shown in FIG. 2, resulting in a fast evaporation on the fluid surface which cools the incoming air.

Another even stronger cooling factor provided by the device is the atomizing. The partial vacuum inside the rotary fan cavity tends to produce a fluid peak 16 and suck some fluid. After getting into the cavity, the sucked fluid moves radially away from the rotation axis of the fan and impacts the blades 9 of the fast rotating fan, producing small droplets. Some of the produced droplets are blown out through the grille outlet 2 after being directed along the guiding wall 12. The droplets that have exited evaporate quickly and cool their ambient air.

Still another cooling factor is the evaporation that occurs on the inner surface of the guiding wall 12. Some of the produced droplets collide with the surface and wet it. The rotating fan provides a good ventilation to the wet surface and evaporates the liquid on the surface, producing additional cooling.

The fluid level can be indirectly monitored by the outgoing droplets. When the production of droplets stops or when the number of the droplets is reduced substantially, it is time to refill the conditioner.

In summary, the evaporative air conditioner of the invention has the ability in providing large areas of evaporative surfaces which include the droplet surfaces, the wet guiding wall surface and the surface of the fluid stored at the base portion of the device. As has been well known for evaporative cooling of open type, high cooling capacity requires that the following two conditions be met: (1) large areas of evaporative surfaces and (2) fast air flow over evaporative surfaces. The air conditioner of the present invention well meets these two conditions, and consequently, has a relatively high cooling capability. Furthermore, the objects and purposes of the present invention, as stated previously, are desirably well realized.

While a specific embodiment of a novel evaporative air conditioner has been disclosed in the foregoing description, it will be understood that various modifications within the spirit of the invention may occur to those skilled in the art. Therefore, it is intended that no limitations be placed on the invention except as defined by the scope of the following claims.

I claim:

1. In an evaporative air conditioner comprising a housing having four side grilles and a top cover secured to said housing by bolts, an electric motor being vertically mounted on said cover with its motor rotating shaft pointing downward, a rotary fan having a cavity formed by fan blades which are retained by a cap and a ring, said fan being connected to said motor rotating shaft at the cap end and being installed vertically, open end or the ring end of said fan facing surface of fluid stored at base portion of said housing, a bent thin guiding wall with its top edge connected to said cover, said wall partially surrounding said fan with open part of the wall serving as air flow exit, said fan sucking fluid stored at base portion of said housing and supplying the fluid onto blades of said fan, and said cover having a fluid fill hole.

2. An evaporative air conditioner as defined in claim 1, wherein the rotary fan has a cavity formed by the fan blades which are retained by the cap and the ring, an upper closed end and a lower open end.

3. An evaporative air conditioner as defined in claim 1, wherein the open end of the rotary fan faces the surface of the fluid stored at the base portion of the conditioner.

4. An evaporative air conditioner defined in claim 1, wherein the fluid stored at the base portion of the conditioner is sucked into the fan cavity formed by the fan blades which are retained by the cap and the ring.

5. An evaporative air conditioner as defined in claim 1, wherein the blades of the rotary fan produce droplets by colliding with the fluid sucked into said cavity.

6. An evaporative air conditioner as defined in claim 1, wherein the upper edge of the guiding wall is connected to the housing cover to force air from the outside of the conditioner to flow towards the surface of the fluid stored at the base portion of the conditioner, and the lower edge is close to the fluid surface to force incoming air to flow closely over the fluid surface.

* * * * *